US010266300B2

(12) United States Patent
Boukobza et al.

(10) Patent No.: US 10,266,300 B2
(45) Date of Patent: Apr. 23, 2019

(54) FLATTENED CONTAINER HAVING AN ARCHED BOTTOM WITH A VARIABLE-WIDTH BASE

(71) Applicant: SIDEL PARTICIPATIONS, Octeville sur Mer (FR)

(72) Inventors: Michel Boukobza, Octeville sur Mer (FR); Camille Guiton, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 365 days.

(21) Appl. No.: 14/779,614

(22) PCT Filed: Apr. 22, 2014

(86) PCT No.: PCT/FR2014/050979
§ 371 (c)(1),
(2) Date: Sep. 24, 2015

(87) PCT Pub. No.: WO2014/174209
PCT Pub. Date: Oct. 30, 2014

(65) Prior Publication Data

US 2016/0046403 A1 Feb. 18, 2016

(30) Foreign Application Priority Data

Apr. 24, 2013 (FR) ..... 13 53757

(51) Int. Cl.
*B65D 1/02* (2006.01)

(52) U.S. Cl.
CPC .... *B65D 1/0276* (2013.01); *B65D 2501/0081* (2013.01)

(58) Field of Classification Search
CPC ..... B65D 11/20; B65D 11/22; B65D 11/24; B65D 1/0276; B65D 2501/0276
(Continued)

(56) References Cited

U.S. PATENT DOCUMENTS

| | | | | |
|---|---|---|---|---|
| 9,199,760 | B2 * | 12/2015 | Nagaoka | B65D 1/0223 |
| 2010/0000963 | A1 | 1/2010 | Inomata et al. | |
| 2014/0374373 | A1 * | 12/2014 | Penet | B65D 1/0276 215/373 |

FOREIGN PATENT DOCUMENTS

| | | | |
|---|---|---|---|
| JP | 2007 039038 | A | 2/2007 |
| WO | 2004/008834 | A2 | 1/2004 |
| WO | 2007/127789 | A1 | 11/2007 |

OTHER PUBLICATIONS

International Search Report, dated Jun. 26, 2014, from corresponding PCT application.

* cited by examiner

*Primary Examiner* — Anthony D Stashick
*Assistant Examiner* — James M Van Buskirk
(74) *Attorney, Agent, or Firm* — Young & Thompson

(57) ABSTRACT

A container (1) made of plastic material, provided with an oblate body (2) and with a bottom (3) in the extension of the body (2) at a lower end thereof, the bottom (3) including: a peripheral base (7) defining an annular standing plane (8) whose contour exhibits, along a long axis, a large dimension A, and, along a short axis perpendicular to the long axis, a small dimension A' that is strictly smaller than the large dimension, a concave arch (13) that extends from the base (7) to a central area (14); wherein the base has:

along the long axis, a width C such that:

$$0.03 \leq \frac{C}{A} \leq 0.1$$

(Continued)

along the short axis, a width C' such that:

$$0.05 \leq \frac{C'}{A'} \leq 0.15.$$

19 Claims, 3 Drawing Sheets

(58) Field of Classification Search
USPC ..... 220/608
See application file for complete search history.

FLATTENED CONTAINER HAVING AN ARCHED BOTTOM WITH A VARIABLE-WIDTH BASE

The invention relates to the field of containers obtained by blow molding or stretch-blow molding from a parison (for example, a preform or an intermediate container) of plastic material such as PET (polyethylene terephthalate).

The invention relates more particularly to flat containers, i.e., to containers exhibiting in cross-section a flattened shape, typically oval or rectangular. This type of container is particularly suited to certain applications (in particular cosmetics) in which the contents have a high viscosity, a pressure on the body of the container facilitating the flow of the contents.

This type of container, however, is not limited to cosmetic applications, and, for ergonomic reasons, it is also used in the packaging of beverages, the flattened section offering in effect a better grip, as is explained in the international application WO 2007/127789 (The Coca Cola Company) or its U.S. equivalent US 2010/0000963.

This advantage in terms of ergonomics, however, comes with a mechanical drawback, namely a certain instability, due to the flattening of the container, which increases the risk of falling over into an axial plane parallel to the small width of the container.

The stability of the container is inversely proportional to its ease of gripping. It is a compromise between these two constraints that is the object of the solution disclosed in the above-mentioned document WO 2007/127789, which proposes, on the one hand, to maintain the W/D ratio (where W is the large width of the container, and D its small width) of between 1.2 and 1.8, and, on the other hand, to provide the bottom of the container with rounded chamfers (sic) whose diameter is smaller in the small width of the container than in its large width.

In actuality, this solution provides only a partial answer to the problem of instability that affects flat containers. In practice, it is found that the natural instability (due to the flat shape) of such a container is often compounded by an instability due to defects in shape on the bottom because of its poor blowability (by "blowability" is meant its ability to take the shape of the mold) due to design defects (essentially of dimensioning).

The problems of blowability are especially difficult to solve on a flat container that inherently is more elongated in the direction of the large width than in the direction of the small width.

A first simple solution could consist in increasing the blow-molding pressure, but the manufacturers encounter necessities of controlling the power consumption of the machines, constraining the blow-molding pressure to a downward trend.

A second simple solution could consist in increasing the blow-molding time (and therefore the cycle time) to facilitate a better taking of an impression of the bottom, but this solution also encounters procedural constraints, whose purpose is to reduce the cycle time to increase the rates of production.

It is therefore understood that it is necessary to improve the shape of the containers to increase their stability while enhancing the blowability.

The purpose of the invention is to propose a flat container that is able to fulfill one or more (and preferably all) of the following objectives:

good stability;

good compromise between ergonomics and stability;

good blowability;

absence of (or almost no) defects of surface evenness on the bottom.

For this purpose, a container is proposed that is made of plastic material, provided with a flattened body and with a bottom in the lengthening of the body at its lower end, the bottom comprising:

a peripheral base defining an annular standing plane whose contour exhibits, along a long axis, a large dimension A, and, along a short axis that is perpendicular to the long axis, a small dimension A' that is strictly smaller than the large dimension, this base having:

along the long axis, a width C such that:

$$0.03 \leq \frac{C}{A} \leq 0.1$$

along the short axis, a width C' such that:

$$0.05 \leq \frac{C'}{A'} \leq 0.15$$

a concave arch that extends from the base to a central area.

Thus dimensioned, this container exhibits both a good rigidity in the area of its base (benefiting the stability of the container), in particular in the plane of the short axis, while offering a good blowability of the base.

Various characteristics can be foreseen, alone or in combination:

the base has, between the standing plane and the arch, an inner annular ledge that is approximately perpendicular to the standing plane, this ledge extending, along the long axis, over a height D such that:

$$0.002 \leq \frac{D}{A} \leq 0.1$$

the height D of the ledge is such that:

$$0.01 \leq \frac{D}{A} \leq 0.05$$

the height D of the ledge is such that:

$$\frac{D}{A} \cong 0.025$$

the ledge extends, along the short axis, over a height D' such that:

$$0.002 \leq \frac{D'}{A'} \leq 0.1$$

the height D' of the ledge is such that:

$$0.01 \leq \frac{D'}{A'} \leq 0.1$$

the height D' of the ledge is such that:

$$\frac{D'}{A'} \cong 0.06$$

the width C of the base along the long axis is such that:

$$\frac{C}{A} \cong 0.05$$

the width C' of the base along the short axis is such that:

$$\frac{C'}{A'} \cong 0.08$$

Other objects and advantages of the invention will be brought out in the description of a preferred embodiment, given below with reference to the accompanying drawings in which:

FIG. 1 shows a container 1 formed by stretch-blow molding, inside a mold having the impression of the container 1, of a preform of plastic material such as PET (polyethylene terephthalate).

Figure 1:
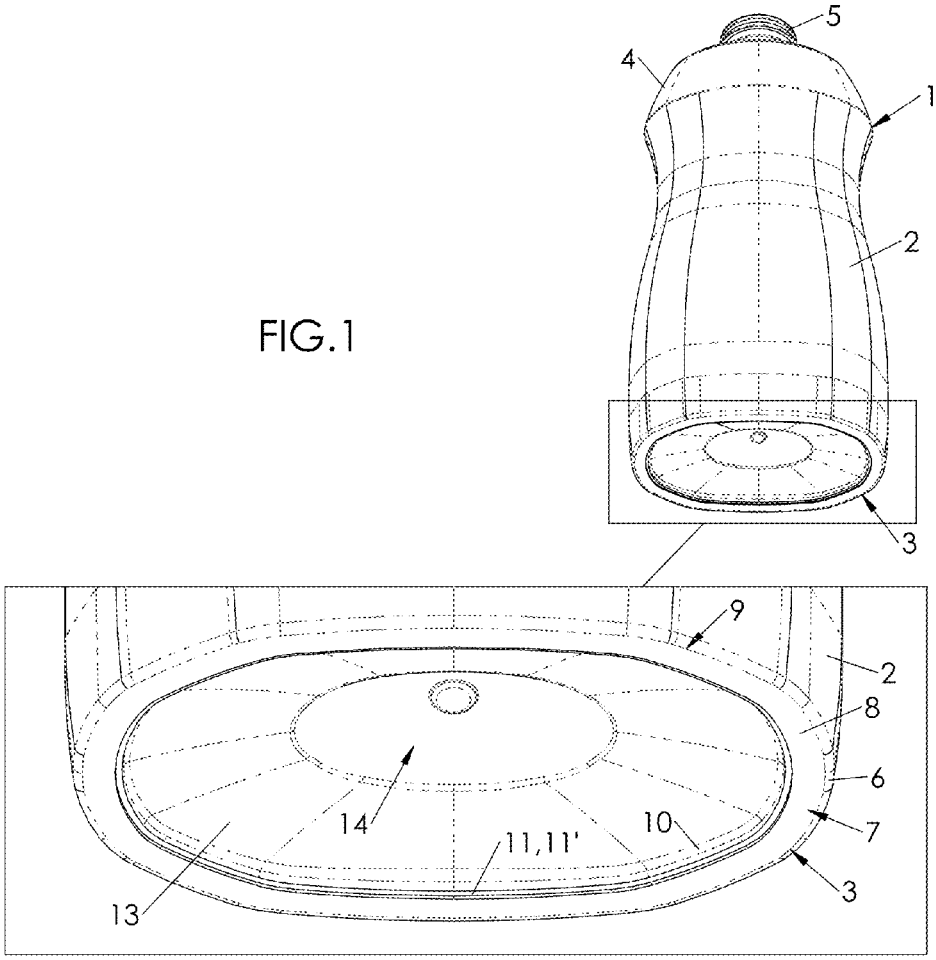
FIG. 1 is a perspective view from below of a container made of plastic material, detailing as an insert, on a larger scale, the bottom of the container.

Container 1 comprises a body 2 that extends along a main axis X and is lengthened, on a lower side, by a bottom 3, and, on an upper side, opposite the bottom 3, by a shoulder 4 itself lengthened by a neck 5 defining a rim.

At the junction between the body 2, at its lower end, and the bottom 3, the container 1 has an outer connecting fillet 6 having a small-radius (less than or equal to 2 mm) arc shape.

The bottom 3 comprises a peripheral base 7 that defines a continuous standing plane 8, approximately perpendicular to the main axis X of the container 1, and by which the bottom can set flat on a flat surface (in particular the upper surface of a table or of a conveyor belt, within a handling machine on a container production line).

The standing plane 8 is delimited transversely toward the outside (i.e., opposite the axis X of the container) by an outer perimeter 9 that is defined on the inside by the fillet 6.

Figure 2:
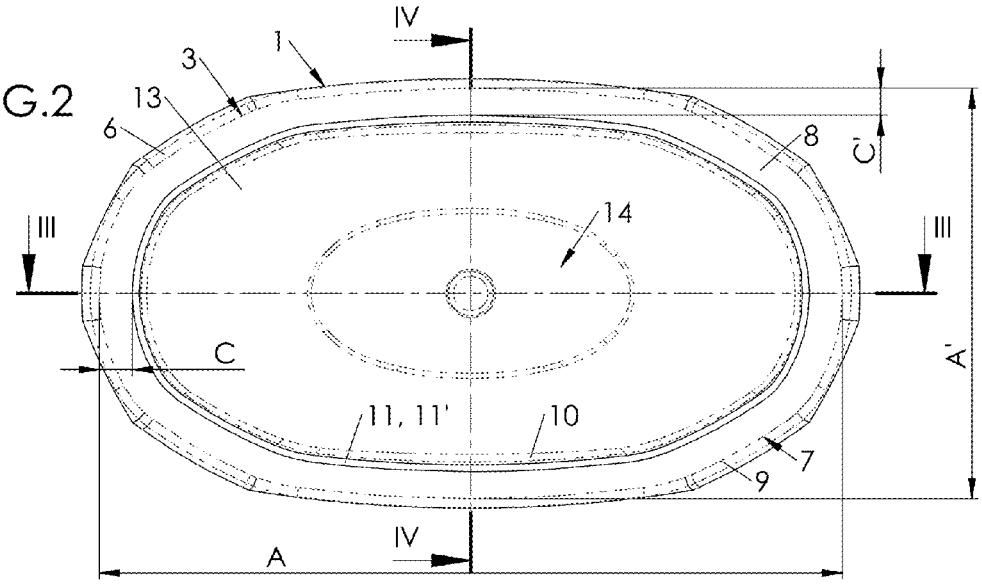
FIG. 2 is a view from below of the bottom of the container of FIG. 1.

The container 1 has, in cross-section (i.e., perpendicular to its axis X), a flattened shape, in this case approximately oval. This shape extends to the bottom 3, in particular in the area of the standing plane 8, whose contour is approximately the same as the body 2 in cross-section and which, like an ellipse, has:

along a long axis (in the cutting plane III-III in FIG. 2, or else in the plane of the sheet in FIG. 3), a large transverse extension A (called large dimension), measured perpendicular to the axis X in the area of the perimeter 9, and along a short axis, perpendicular to the long axis (i.e., in the cutting plane IV-IV in FIG. 2, or else in the plane of the sheet in FIG. 4), a transverse extension A', also measured perpendicular to the axis X in the area of the perimeter, this small transverse extension (called small dimension) being strictly smaller than the large dimension A:

$$\frac{A'}{A} < 1$$

The base 7 comprises an inner annular ledge 10 that extends axially toward the interior of the container 1 in the lengthening of the standing plane 8, approximately perpendicular in relation to it. According to a first embodiment illustrated in FIGS. 3 and 4, the base 7 comprises an inner fillet 11 having a small-radius (less than or equal to about 2 mm) arc shape, which connects the standing plane 8 to the ledge 10.

Figure 5:
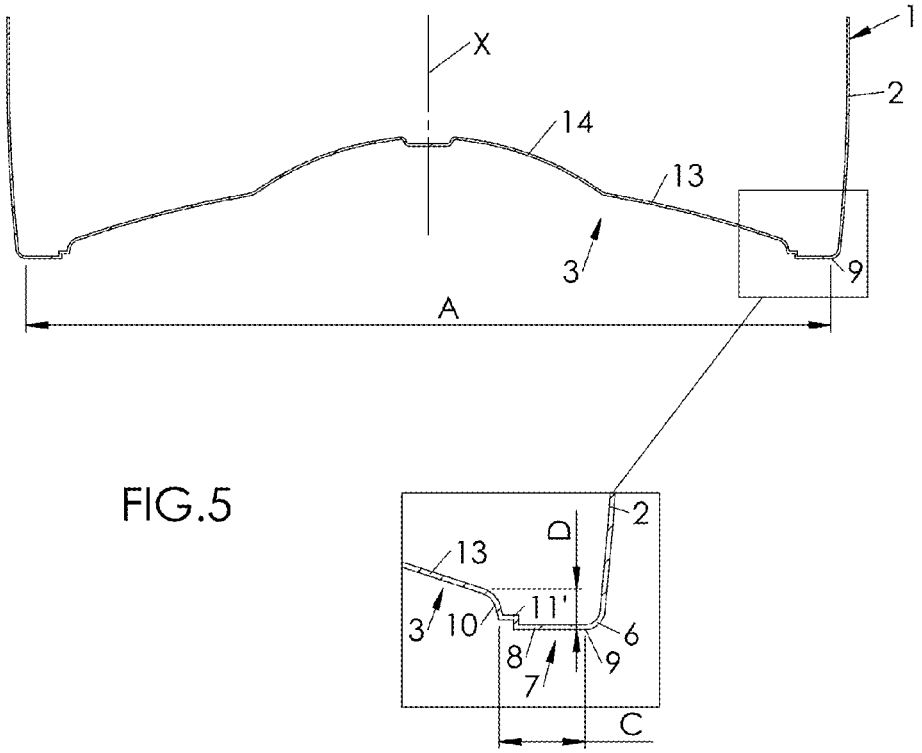
FIG. 5 is a view similar to FIG. 3, according to a second embodiment.
Figure 6:
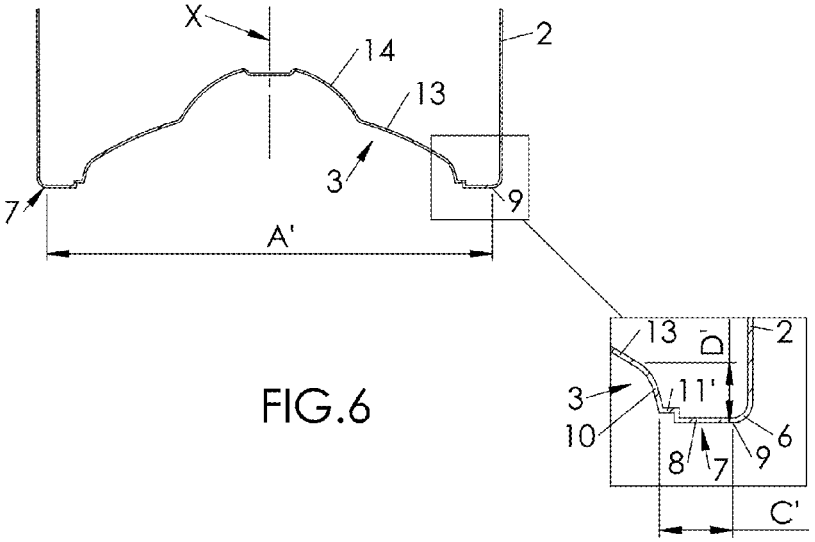
FIG. 6 is a view similar to FIG. 4, according to the second embodiment.

According to a second embodiment illustrated in FIGS. 5 and 6, the base 7 comprises, instead of a fillet for connecting the standing plane 8 to the ledge 10, a step 11' forming a setback at the junction between the standing plane 8 and the ledge 10. This step 11' can be used as a recessed reserve making it possible to offset toward the interior of the container 1 a possible burr resulting from the flow of material from a seam of the mold in which the container is formed, this seam being defined between a wall of the mold (at the impression of the body and of the standing plane) and a mold bottom (at the impression of the arch).

The standing plane 8 is delimited transversely toward the interior (i.e., in the direction of the axis X of the container) by an inner perimeter 12, defined on the outside by the inner fillet 11 (in the case of the first embodiment) or, respectively, by an inner edge of the step 11', at its junction with the ledge 10 (in the case of the second embodiment).

The bottom 3 further comprises a concave arch 13, with concavity turned toward the exterior of the container 1. This arch 13 extends from the base 7, in the lengthening of the ledge 10, to a central area 14 of the bottom that defines a piece that extends axially projecting toward the interior of the container 1.

Figure 3:
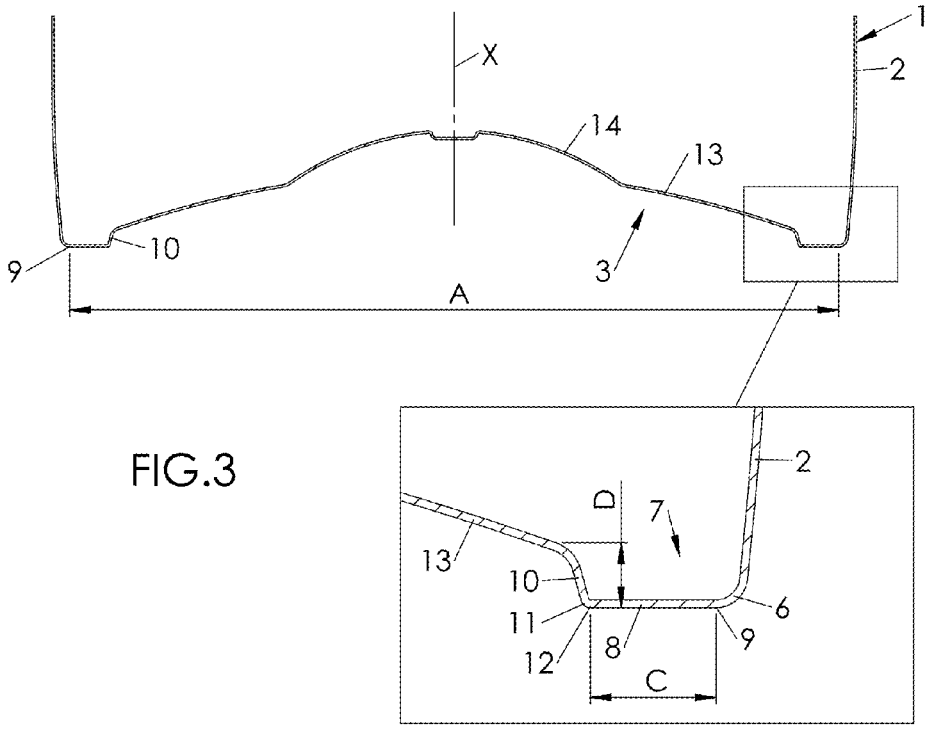
FIG. 3 is a detail view in cross-section of the container of FIG. 2, along the cutting plane III-III, according to a first embodiment.
Figure 4:
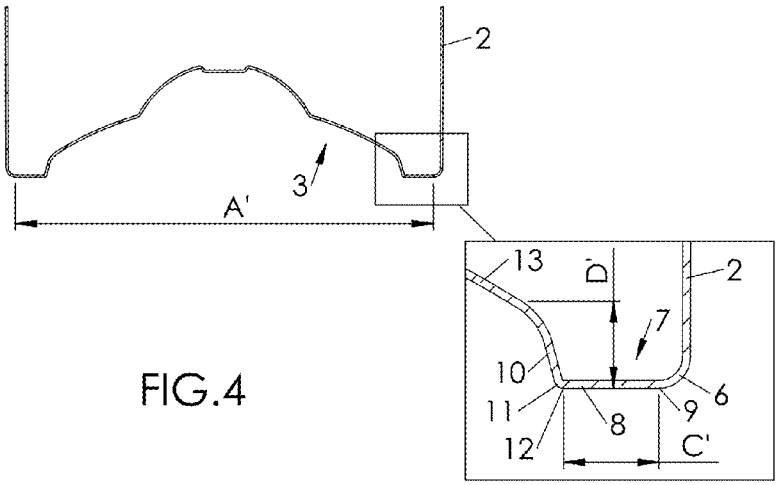
FIG. 4 is a detail view in cross-section of the container of FIG. 2, along the cutting plane IV-IV, according to the first embodiment.

Noted:

C is a width of the standing plane 8 (merged with a width of the base 7), measured radially along the long axis between the inner perimeter 12 and the outer perimeter 9, respectively between an inner edge of the step 11', at its junction with the ledge 10, and the outer perimeter 9;

C' is the width of the standing plane 8 measured radially along the short axis;

D is a height of the ledge 10 (merged with an inner height of the base 7), measured along the long axis (i.e., in the cutting plane III in FIG. 3, or in the plane of the sheet in FIG. 3 or FIG. 5) between the standing plane 8 and the junction of the ledge 10 with the arch 13;

D' is the height of the ledge 10 measured along the short axis (i.e., in the cutting plane IV in FIG. 3, or in the plane of the sheet in FIG. 4 or FIG. 6).

The bottom 3 is designed to maximize the stability of the base 7 while facilitating its blowability.

For this purpose, the base 7 is dimensioned such that its width C can be varied as a function of its transverse extension. More specifically, the width C of the base 7 is dimensioned in the following manner:

firstly, the width C of the base 7 along the long axis is such that:

$$0.03 \leq \frac{C}{A} \leq 0.1$$

with, preferably:

$$\frac{C}{A} \cong 0.05$$

secondly, the width C' of the base 7 along the short axis is such that:

$$0.05 \leq \frac{C'}{A'} \leq 0.15$$

with, preferably:

$$\frac{C'}{A'} \cong 0.08$$

Furthermore, the width C of the base 7 along the long axis is preferably strictly greater than its width C' along the short axis:

$$C>C'$$

The ledge 10 is also dimensioned as a function of the transverse dimension of the base 7:

firstly, the height D of the base measured along the long axis is such that:

$$0.002 \leq \frac{D}{A} \leq 0.1$$

with, preferably:

$$0.01 \leq \frac{D}{A} \leq 0.05$$

and, according to a particular embodiment:

$$\frac{D}{A} \cong 0.025$$

secondly, the height D of the base measured along the long axis is such that:

$$0.002 \leq \frac{D'}{A'} \leq 0.1$$

with, preferably:

$$0.01 \leq \frac{D'}{A'} \leq 0.1$$

and, according to a particular embodiment:

$$\frac{D'}{A'} \cong 0.06$$

This dimensioning makes it possible to maintain a good stability of the container 1 in particular in the plane of the short axis (i.e., the small dimension), while maintaining a good blowability of the container in the plane of the long axis, where the stretching is more difficult but where the stability of the container 1 is, of course, better.

The larger width of the standing plane 8 along the long axis contributes to a good blowability of the base 7 in this direction, minimizing the risk of the appearance of distortions (or defects of surface evenness) on the standing plane 8.

In addition, the narrowness of the standing base 7 along the short axis imparts an almost linear character to it, which reduces the risks of hyperstatism of the base 7 and consequently increases the stability of the container 1.

The dimensioning of the ledge 10 contributes in particular:

to a better blowability of the bottom 3 in the plane of the long axis, by minimizing the amount of material that an axial stretching requires;

to a better rigidity of the arch 13, thanks to the variation of height of its outer perimeter (at its junction with the ledge 10);

to a greater rigidity of the base 7 along the short axis, benefiting its stability in this direction.

To form such a container 1, it is preferable to resort to the boxing technique, in which the container 1 is blow molded in a mold provided with a lateral wall defining a cavity having the impression of the body 2 and a mold bottom that is mounted to move in relation to the wall between a low position in which the bottom is separated from the cavity, and a high position in which the bottom closes the cavity by completing the impression of the container 1. The mold bottom, initially in low position, rises during the blow molding, which leads to an over-stretching of the material in the area of the bottom 3, which can facilitate its impression-taking in particular in the area of the base 7.

The invention claimed is:

1. A container (1) made of plastic material, provided with a flattened body (2) and with a bottom (3) in the lengthening of the body (2) at its lower end, the bottom (3) comprising:

a peripheral base (7) defining an annular standing plane (8) whose contour exhibits, along a long axis, a large dimension A, and, along a short axis that is perpendicular to the long axis, a small dimension A' that is strictly smaller than the large dimension, a concave arch (13) that extends from the peripheral base (7) to a central area (14);

wherein:

the peripheral base (7) has:

along the long axis, a width C such that:

$$0.03 \leq \frac{C}{A} \leq 0.1$$

along the short axis, a width C' such that:

$$0.05 \leq \frac{C'}{A'} \leq 0.15.$$

2. The container (1) according to claim 1, wherein the base (7) has, between the standing plane (8) and the arch (13), an inner annular ledge (10) that is approximately perpendicular to the standing plane (8), this ledge (10) extending, along the long axis, over a height D such that:

$$0.002 \leq \frac{D}{A} \leq 0.1.$$

3. The container (1) according to claim 1, wherein the width C of the base along the long axis is such that:

$$\frac{C}{A} \cong 0.05.$$

4. The container (1) according to claim 1, wherein the width C' of the base along the short axis is such that:

$$\frac{C'}{A'} \cong 0.08.$$

5. The container (1) according to claim 1, wherein the width C of the base along the long axis is such that:

$$C>C'.$$

6. The container (1) according to claim 2, wherein the height D of the ledge (10) is such that:

$$0.01 \leq \frac{D}{A} \leq 0.05.$$

7. The container (1) according to claim 6, wherein the ledge (10) extends, along the short axis, over a height D' such that:

$$0.002 \leq \frac{D'}{A'} \leq 0.1.$$

8. The container (1) according to claim 7, wherein the height D' of the ledge (10) is such that:

$$0.01 \leq \frac{D'}{A'} \leq 0.1.$$

9. The container (1) according to claim 7, wherein the height D' of the ledge (10) is such that:

$$\frac{D'}{A'} \cong 0.06.$$

10. The container (1) according to claim 2, wherein the height D of the ledge (10) is such that:

$$\frac{D}{A} \cong 0.025.$$

11. The container (1) according to claim 10, wherein the ledge (10) extends, along the short axis, over a height D' such that:

$$0.002 \leq \frac{D'}{A'} \leq 0.1.$$

12. The container (1) according to claim 11, wherein the height D' of the ledge (10) is such that:

$$\frac{D'}{A'} \cong 0.06.$$

13. The container (1) according to claim 2, wherein the ledge (10) extends, along the short axis, over a height D' such that:

$$0.002 \leq \frac{D'}{A'} \leq 0.1.$$

14. The container (1) according to claim 13, wherein the height D' of the ledge (10) is such that:

$$0.01 \leq \frac{D'}{A'} \leq 0.1.$$

15. The container (1) according to claim 13, wherein the height D' of the ledge (10) is such that:

$$\frac{D'}{A'} \cong 0.06.$$

16. The container (1) according to claim 2, wherein a height D' of the ledge (10) is such that:

$$0.01 \leq \frac{D'}{A'} \leq 0.1.$$

17. The container (1) according to claim 2, wherein the width C of the base along the long axis is such that:

$$\frac{C}{A} \cong 0.05.$$

18. The container (1) according to claim 2, wherein the width C' of the base along the short axis is such that:

$$\frac{C'}{A'} \cong 0.08.$$

19. The container (1) according to claim 2, wherein the width C of the base along the long axis is such that:

$$C>C'.$$

* * * * *